United States Patent [19]

Pehr

[11] Patent Number: 4,925,041

[45] Date of Patent: May 15, 1990

[54] CLOSURE FOR CONTAINER

[76] Inventor: Harold T. Pehr, 3920 W. 96th St., Overland Park, Kans. 66207

[21] Appl. No.: 277,228

[22] Filed: Nov. 29, 1988

Related U.S. Application Data

[63] Continuation of Ser. No. 160,571, Feb. 26, 1988, Pat. No. 4,787,526.

[51] Int. Cl.[5] ..... B65D 55/02

[52] U.S. Cl. ..... 215/216; 215/237

[58] Field of Search ..... 215/216, 224, 235, 237, 215/238, 245; 222/153

[56] References Cited

U.S. PATENT DOCUMENTS

| | | | |
|---|---|---|---|
| Re. 29,793 | 10/1978 | Pehr | 222/153 |
| 357,769 | 11/1971 | Hentschke et al. | 215/245 |
| 3,623,622 | 11/1971 | Sullivan | 215/213 |
| 3,790,015 | 2/1974 | Imamura | 215/209 |
| 3,826,394 | 7/1974 | Stull | 215/224 |
| 3,830,391 | 8/1974 | Uhlig | 215/216 |
| 3,830,393 | 8/1974 | Schaefer | 215/209 |
| 3,871,662 | 3/1975 | Happ et al. | 215/223 |
| 3,894,647 | 7/1975 | Montgomery | 215/216 |
| 3,923,180 | 12/1975 | Fields | 215/216 |
| 4,127,221 | 11/1978 | Vera | 215/214 |
| 4,144,983 | 3/1979 | Pauls et al. | 215/216 |
| 4,154,353 | 5/1979 | Hoo | 215/224 X |
| 4,170,315 | 10/1979 | Dubach et al. | 220/339 |
| 4,244,495 | 1/1981 | Lorschied et al. | 215/224 |
| 4,353,483 | 10/1982 | Pehr | 215/216 |
| 4,360,113 | 11/1982 | Luker | 215/216 |
| 4,424,910 | 1/1984 | Heinol | 215/216 |
| 4,429,800 | 2/1984 | Greenspan | 215/216 |
| 4,629,081 | 12/1986 | McLaren | 215/224 X |
| 4,718,567 | 1/1988 | LaVange | 215/216 |

FOREIGN PATENT DOCUMENTS

| | | | |
|---|---|---|---|
| 1527812 | 10/1978 | United Kingdom | 215/224 |

*Primary Examiner*—Stephen Marcus
*Assistant Examiner*—Nova Stucker
*Attorney, Agent, or Firm*—Litman, McMahon & Brown

[57] ABSTRACT

A vial or other container includes a hinged closure member having a latch for securing the closure member in a closed position. The latch includes a "child resistant" configuration wherein it is very difficult for adolescents to open the container and an "easy open" configuration wherein it is relatively simple for persons with limited manual dexterity to open the closure member. The latch includes a bipositional tongue hingedly attached to either the container or closure member. The tongue is hinged to allow for the various configurations and, when in the child proof configuration, substantially requires use of both hands and a substantial amount of dexterity in order to open the closure member. Various devices are further provided to protect the tongue from manipulation by adolescents and for indicating previous tampering with the container. The closure member is connected by a hinge to the container. The hinge includes a bar attached to either the container or the closure member and a semi-circular sleeve which rotates about the bar and that is attached to the opposite of the container or the closure member.

8 Claims, 6 Drawing Sheets

Fig. 1.
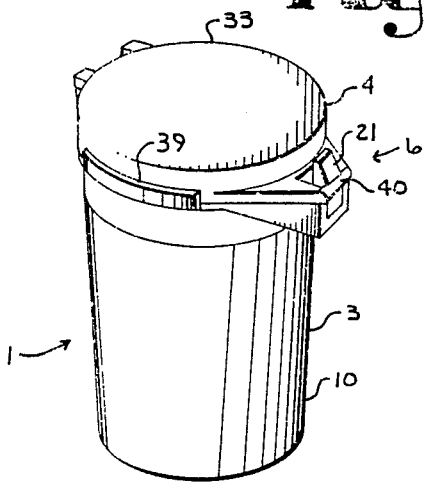
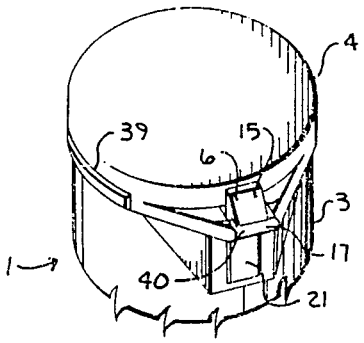
Fig. 2.
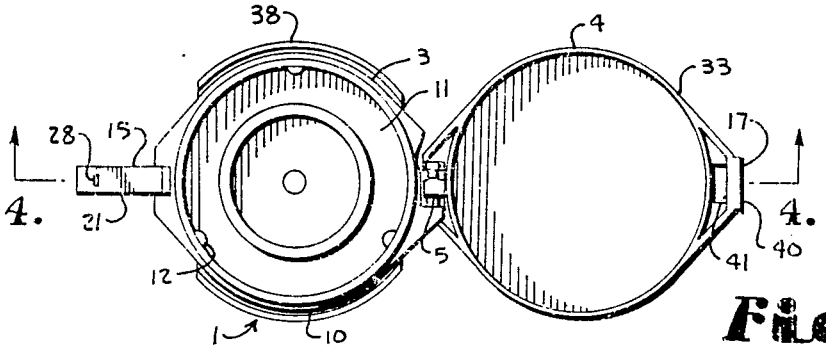
Fig. 3.
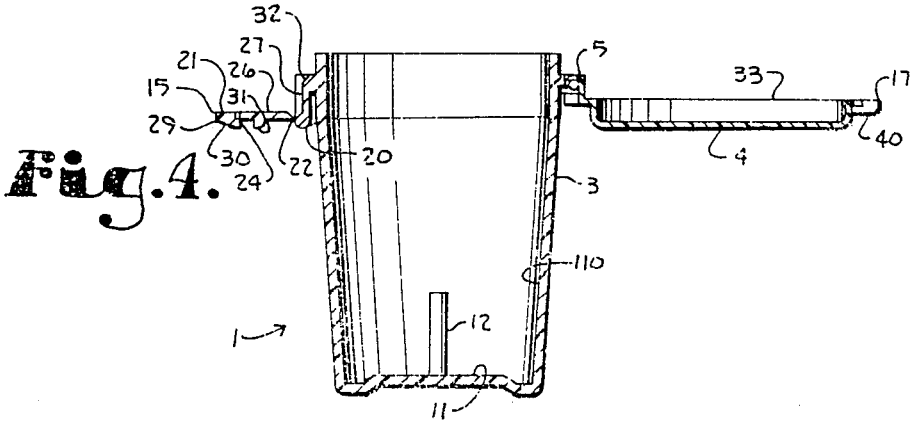
Fig. 4.

Fig. 5.
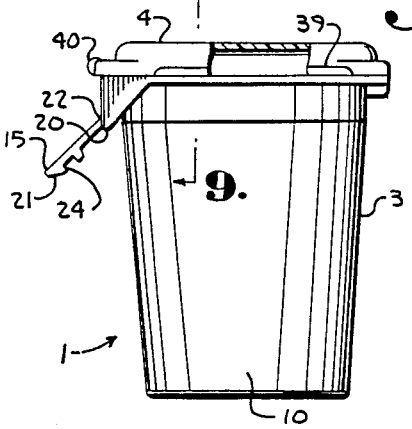
Fig. 6.
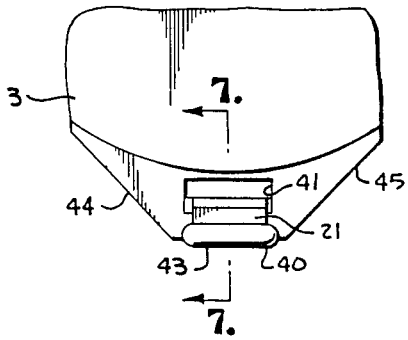
Fig. 7.
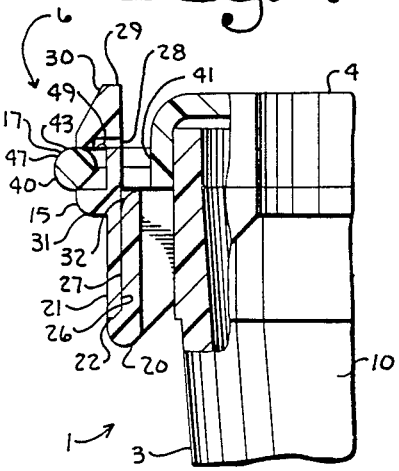
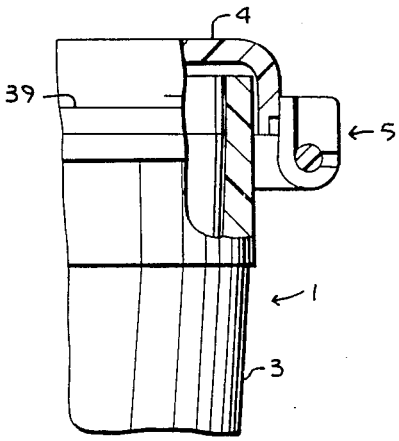
Fig. 8.
Fig. 9.
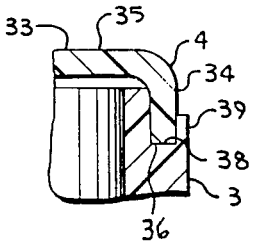

Fig. 10.
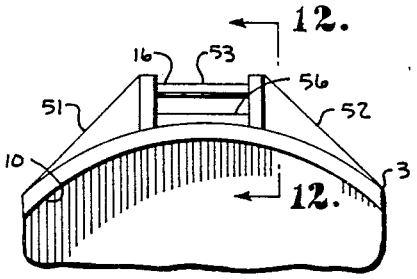
Fig. 11.
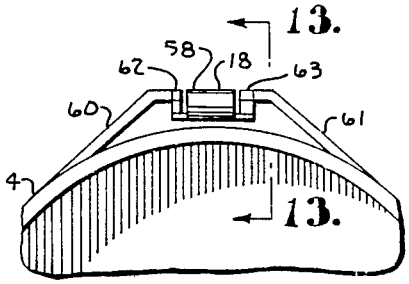
Fig. 12.
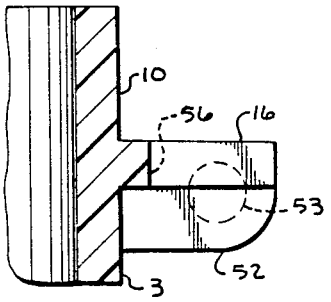
Fig. 13.
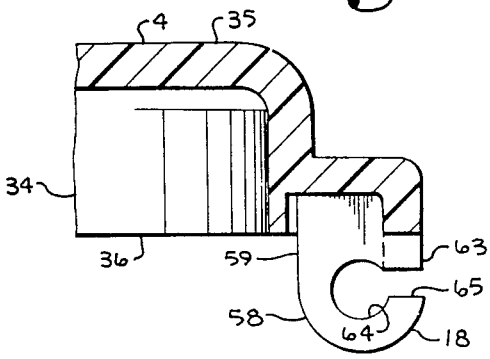
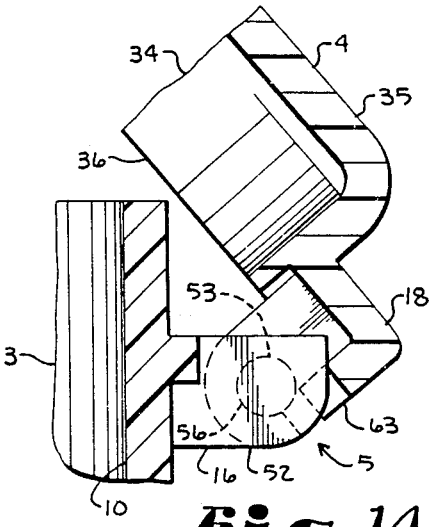
Fig. 14.
Fig. 15.
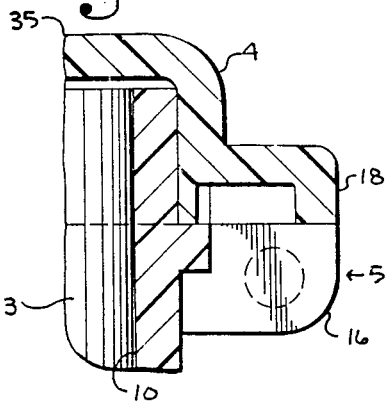

Fig. 28.
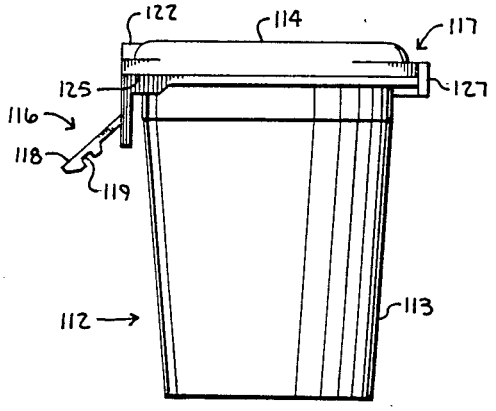
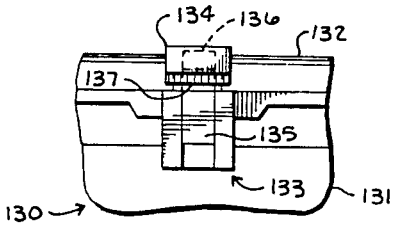
Fig. 31.
Fig. 30.
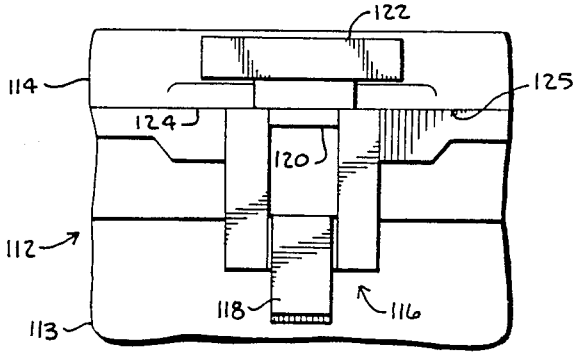
Fig. 29.
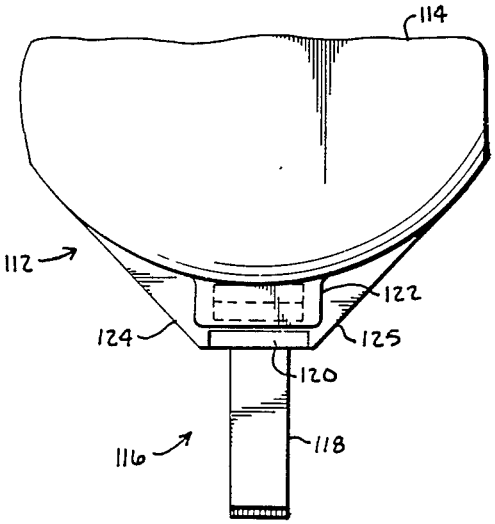
Fig. 32.
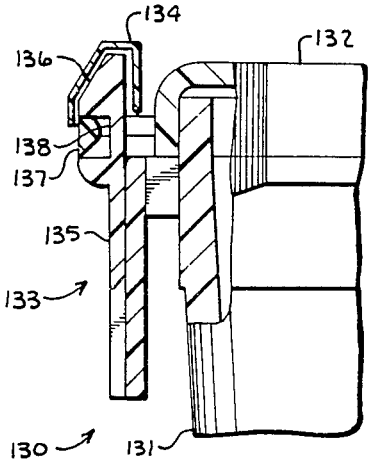

CLOSURE FOR CONTAINER

CROSS-REFERENCE TO RELATED APPLICATION

The present application is a continuation of U.S. Patent Application Ser. No. 160,571, filed Feb. 26, 1988, entitled CONTAINER CLOSURE, now Pat. No. 4,787,526.

BACKGROUND OF THE INVENTION

The present invention relates to child resistant closures for containers having medicinals or other dangerous materials therein and, in particular, to such a container having a bipositional latch which allows adults of limited dexterity to easily open the container in one configuration and which provides a substantial amount of resistance to adolescents in opening the container when in the other configuration. Further, a hinge is provided which allows a closure member for the container to be molded separately from the remainder of the container, yet which prevents easy removal of the closure member from the hinge side when the closure member is closed. This allows a separately molded closure member to be easily mated with the container when the closure member is in an open position thereof.

For many years, both governmental and industry standards have been promulgated to attempt to prevent accidental poisoning or injury to children by making it relatively difficult for children to open certain types of containers, for example, pharmacy vials containing drugs. Unfortunately, most of the developments which make containers difficult to open by children also make the containers difficult to open by adults. This is especially true of adults having limited manual dexterity, such as both younger and older adults suffering from arthritis and other diseases or those having injuries which lessen the dexterity of the person.

Various prior art devices have been developed which attempt to provide both a difficult to open container when the product is being used in the presence of children and an easy open container for persons having limited dexterity. One such device of this type is described in applicant's Pat. No. 4,353,483 which included a bipositional hinged tab which made the lid easy to open when in one position and relatively difficult to open in another position.

Unfortunately, the prior art devices have had somewhat mixed success with children, since children can be quite creative in opening containers. This is especially true where a child is willing to use his or her teeth to attempt to open the lid of a container. The child is often able to make up for the loss of manual dexterity or the inability to understand how to open the lid through the strong pressure that can be exerted by the teeth and which can pry the lid open or bite off portions of the latch to allow the lid to open. Certain prior art devices have attempted to circumvent the problem of the child using the child's teeth to open the latch by the positioning of guard members to keep the child's teeth from engaging the lifting tab (for example, see the U.S. patent to Stull Ser. No. 3,826,394).

None of the prior art devices has highly effectively and inexpensively combined a structure which can be configured so that it is easy opening for adults and yet which can be configured so that it is very difficult to open by children.

It is also becoming increasingly evident to product safety specialists that closure members for certain types of containers, especially pharmaceutical vials, should be designed such that the lid once attached to the body is always maintained connected to the body of the container and preferably such that the lid can be closed using a single hand. That is, that a user can both swing the lid into a closed position while holding the vial with the same hand that is being utilized to swing the lid and that the lid will then automatically lock in a secured configuration when the lid is closed. This concept is frequently referred to as "one hand and one motion to close".

It is also desirable that the container include a hinge for connecting the lid to the body of the container that is also difficult for a child to manipulate and, thereby, open the container from the rear thereof. There is also a need in the industry for the lid to be able to be removed from the container when in the open configuration thereof such that the lid ca be individually molded from the container. This allows one standard size lid to be manufactured for multiple sized containers or vials at a substantial savings in molding expense.

It is still further desirable that such a hinge hold the lid in at least one predetermined open position such that the lid will not flop freely back into a closed position, thereby making manipulation of the vial difficult.

It is also desirable to be able to provide covers or shields for both the latch and hinge to further prevent tampering with these structures by children using their teeth. In addition, the region between the container lid and body other than at the latch and hinge is preferably also protected from children prying apart the lid from the body in this region.

Finally, it is desirable in some instances to be able to provide a tamper indicating mechanism on the container which indicates that the lid has been previously opened. This is especially true of pharmaceuticals that are sold over the counter in order to alleviate concerns that the drugs therein have been poisoned.

OBJECTS OF THE INVENTION

Therefore, the objects of the present invention are: to provide a container having a closure member and a latch for the closure member which is alternatively adjustable to an easy opening configuration or to a child resistant configuration; to provide such a latch that, when in the child resistant configuration thereof, is relatively inaccessible to a child's teeth; to provide such a latch wherein the latch mechanism includes a bipositional and resilient tang or tongue with an outward projecting tooth on a distal end thereof and with an opposite end thereof connected to either the container body or the closure member and with the opposite of the container body or closure member including a bar behind which the tooth flexibly passes upon closing of the closure member such that the tooth is resiliently biased to remain in such position until manipulated by a person opening the container; to provide such a latch wherein the person opening the latch must both push radially against the resiliency of the tongue while pulling upwardly on the closure member thereby requiring simultaneous manipulation of at least three different fungi to open the closure member; to provide such a latch wherein the degree to resistance provided by the latch member to opening is a function of the support provided directly behind the tongue in conjunction with the flexibility of the tongue; to provide such a container having a hinge thereon which allows rotation of the closure member relative to the container body when the closure member is in an open position thereof; to provide such a hinge including a spaced but generally tangentially extending bar-like structure on a first of the closure member or container body and with a semi-circular sleeve member on the opposite of the closure member or container body such that the semi-circular member rotates about the bar; to provide such a hinge wherein the semi-circular member is aligned such that when the closure member is in the closed position thereof, the semi-circular member cannot be readily removed from the bar, whereas when the closure member is in at least one open position thereof, the semi-circular member can be removed from or placed on the bar, thereby allowing the container to be manufactured in two parts; to provide such a container having protective shields passing over the latch member tongue and over the hinge semi-circular member so as to limit accessibility of children's teeth thereto; to provide such a container wherein a seal is formed between the closure member and container body between the hinge and latch and wherein the seal is configured so as to prevent an adolescent from prying the closure member apart from the container body in this region; to provide such a container wherein the container includes a tamper indicating mechanism to indicate that the container has been previously entered; to provide latch mechanism and a hinge mechanism which is readily applicable to a wide variety of containers including pharmacy vials, aerosol cans, blow molded bottles, bottles with retainer rings and the like; and to provide such a container which is relatively inexpensive to manufacture, easy to use and particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a container having a container body, a closure member, a latch, and a hinge connecting the closure member to the container body.

FIG. 2 is a fragmentary perspective view of the container, showing the latch in greater detail and the closure member in a closed configuration thereof.

FIG. 3 is a top plan view of the container showing the closure member thereof in an open configuration.

FIG. 4 is a cross-sectional view of the container showing the closure member in an open configuration thereof and showing the latch in an easy open configuration thereof, taken along line 4—4 of FIG. 3.

FIG. 5 is a side elevational view of the container with portions broken away to show detail thereof, with the closure member in the closed configuration thereof and with the latch in the easy open position thereof.

FIG. 6 is an enlarged and fragmentary top plan view of the container showing the latch thereof.

FIG. 7 is an enlarged and fragmentary cross-sectional view of the container showing the latch thereof, taken along line 7—7 of FIG. 6.

FIG. 8 is an enlarged and fragmentary side elevational view of the container showing the hinge thereof, with portions broken away to show detail of the hinge.

FIG. 9 is a cross-sectional view of the container, taken along line 9—9 of FIG. 5.

FIG. 10 is a top plan view of the container body of the container with the closure member removed therefrom, showing a portion of the hinge.

FIG. 11 is a fragmentary and enlarged bottom plan view of the closure member of the container, showing a portion of the hinge thereof.

FIG. 12 is an enlarged and fragmentary side and cross-sectional elevational view of the container, showing a portion of the hinge and taken along line 12—12 of FIG. 10.

FIG. 13 is an enlarged and fragmentary side and cross-sectional elevational view of the closure member of the container, showing a portion of the hinge and taken along line 13—13 of FIG. 11.

FIG. 14 is an enlarged and fragmentary side elevational view of the container showing the hinge in detail and showing the closure member in an open configuration thereof.

FIG. 15 is an enlarged and fragmentary cross-sectional side elevation view of the container, showing the hinge and showing the closure member in a closed configuration thereof.

FIG. 28 is a side elevational view of a third modified container in accordance with the present invention, including a container body, a hinged closure member and a latch wherein lifting tabs offset from the latch are provided on the closure member.

FIG. 29 is an enlarged and fragmentary top plan view of the third modified container, showing the latch in an easy open configuration thereof.

FIG. 30 is a fragmentary and enlarged front elevational view of the third modified container, showing the closure member thereof in a closed configuration and showing the latch thereof in a child resistant configuration.

FIG. 31 is a fragmentary front elevational view of a fourth modified container in accordance with the present invention showing a container body, a closure member, a latch and a tamper indicating device.

FIG. 32 is an enlarged and fragmentary side elevational view of the fourth modified container with the latch thereof in a child resistant configuration and with the tamper indicating device in position, with portions broken away to show detail thereof.

DETAILED DESCRIPTION OF THE INVENTION

Figure 16:
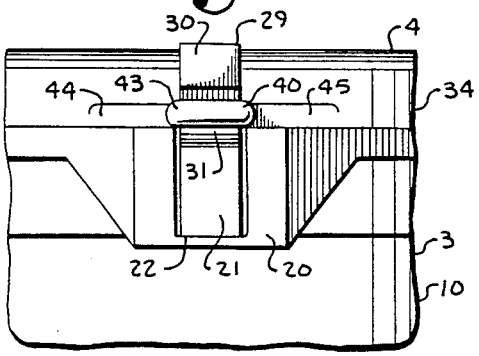
FIG. 16 is a fragmentary and enlarged front elevational view of the container showing the latch member in a child resistant configuration thereof.
Figure 17:
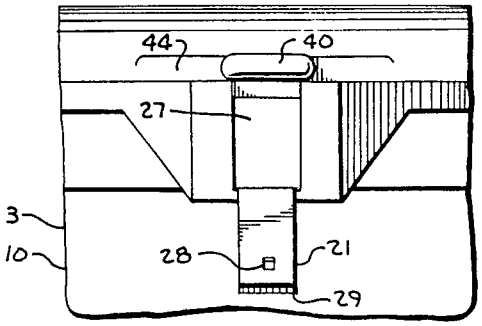
FIG. 17 is an enlarged and fragmentary front elevational view of the container, showing the latch in an easy open configuration and showing the closure member in a closed configuration thereof.
Figure 18:
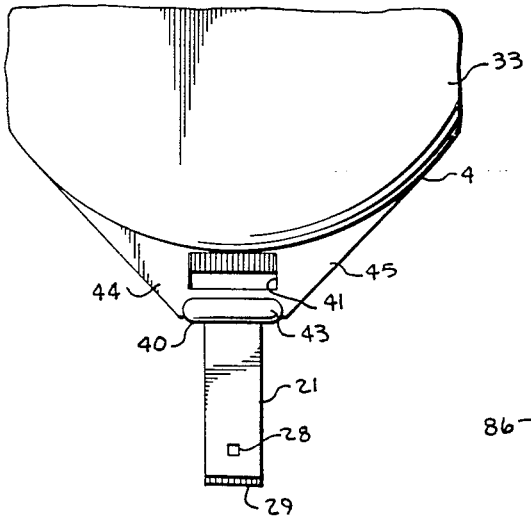
FIG. 18 is an enlarged and fragmentary top plan view of the container with the latch in the open configuration thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

FIGS. 1 through 21 illustrate a first container in accordance with the present invention, generally designated by the reference numeral 1. The container 1 includes a container body 3, a closure member 4, a hinge mechanism 5 rotatably connecting the closure member 4 to the container body 3 and a latch mechanism 6 for securing the closure member 4 in a closed configuration to the container body 3.

The container body 3 of the illustrated embodiment is a vial-like structure having a generally cylindrical side wall 10 and a bottom wall 11 secured to the side wall 10. The side wall 10 is slightly tapered toward the bottom and includes inwardly projecting beads 12 such that multiple container bodies 3 with the closure members thereof in an open position can be stacked together and such that the beads 12 allow the stacked or nested container bodies 3 to be removed from one another, as the beads 12 function to prevent a vacuum from being formed between adjacent container bodies 3.

Although a vial-like structure has been shown herein as the container body 3, it is foreseen that the container body could be many different structures such as a squeeze tube, liquid dispensing bottles, including pour and squirt liquid dispensers, aerosol cans, blow molded bottles and the like. It is also foreseen under the present invention that the container body could essentially be only an attachment ring for mounting on a retention ring of a glass bottle, a mechanical structure having a lid, such as a copy machine or the like. In particular, it is foreseen that the present invention can be utilized with a wide variety of devices wherein it is advantageous to protect such a device from being easily opened by children and yet wherein it is desirable for adults of limited dexterity to be able to open the device.

A first portion 15 of the latch mechanism 6 and a first portion 16 of the hinge mechanism 5 are fixedly attached to the container body 3. Likewise, a second portion 17 of the latch mechanism 6 and a second portion 18 of the hinge mechanism 5 are attached to the closure member 4.

The latch mechanism first portion 15 comprises a radially outwardly projecting carrier 20 and a tang or tongue 21 which is connected to the carrier at the lower end thereof by a hinge 22. As used herein, the terms "upper", "lower", "front", "back" and the like refer to the direction provided in the description of the drawings and, in particular, "front" is to the left in FIG. 4. The distal part of the tongue 21 is thicker or wider than the attached part thereof. The distal half of the tongue 21 includes a rectangularly shaped recess 24. The recess 24 opens radially outward when the latch mechanism 6 is in a hard to open configuration thereof, such as seen in FIG. 7.

The tongue 21 also has a back surface 26 which is opposite the recess 24 and which is generally planar. The carrier 20 includes a mating surface 27 which partly abuts against the tongue back surface 26 when the tongue 21 is in the hard to open configuration thereof. The mating surface 27 extends from near the tongue hinge 22 to near the lower edge of the recess 24. As will be discussed later, the extension of the mating surface 27 is important in determining how easy or how hard the latch mechanism 6 is to open. It is noted that unless the hinge 22 is designed to have limited flexibility, the position of the hinge 32 must be below the top of the mating surface 27 such that the tongue 21 will abut against the surface 27 at full extension of the hinge 22 and provide a backstop for the lower part of the tongue 21, while the tongue upper or distal end 29 is being biased backwards.

On the most outward side of the recess 24 is a relatively small elongate channel 28. Also extending from near the recess 24 to near the distal end 29 of the tongue is a slanted cam surface 30. It is noted that the tongue 21 has an easy open configuration which is illustrated in FIG. 5 wherein the tongue 21 is rotated on the hinge 22 such that the back surface 26 does not engage the mating surface 27.

The tongue 21 is constructed of a relatively resilient but bendable material if sufficient force is applied thereto. The tongue 21, when in the hard to open configuration thereof, is bendable at the upper end thereof about an upper edge 32 of the mating surface 27.

There is a radius or curved surface extending back from the upper edge 32 about which the tongue 21 bends. The degree of the radius and the placement of the edge 32 relative to the recess 24 also regulate the degree of difficulty in opening the latch mechanism 6 when in the hard to open configuration. In particular, as the edge 32 is raised and as the degree of radius is lessened, the latch mechanism 6 becomes harder to open because it is harder than to bend the tongue distal end 29 rearward so as to clear the latch mechanism second portion 17 and allow the closure member 4 to be opened.

The lower side of the recess 24 has associated therewith a bar-like structure 31 that extends across the front of the tongue. The structure 31 functions as a lower projection and further limits the ease of opening of the latch mechanism 6. In particular, the structure 31 prevents a user from simultaneously pushing inward on the tongue 21 and upward on the latch mechanism second portion 17. It is foreseen that the structure 31 may be not included if it is desirable to have an easy open latch of this type, such as on a lunch box.

As seen in FIG. 7, the upper end of the tongue 21 is bendable or rotatable to the right with the edge 32 acting as a fulcrum for such bending. The mating surface 27 cooperatively prevents a user from depressing the tongue 21 from beneath the recess 24 such that the user must push against the tongue 21 above the recess 24. As will be noted below, this requires at least two manual operations to be applied to open the container 1 in addition to requiring the container 1 to be held, since a user cannot push upward on the closure member 4 with the same finger or thumb being used to depress the tongue 4.

The latch mechanism second portion 17 is fixedly secured to the closure member 4 and extends radially outward therefrom. The closure member 4 of the illustrated embodiment comprises a cap or lid 33 having a circumferential side wall 34 and a top 35. A bottom edge 36 of the wall 34 seats in a corresponding recess 38 in the top of the container body 3. The recess 38 has an outer wall or ridge 39 that extends somewhat above the bottom of the closure member 4 when in the closed configuration thereof so as to prevent a child from placing his or her teeth under the closure member 4 and prying it upward. This feature could also be provided by providing a reverse draft or a bead and groove mating between the surface of the container body 3 and closure member 4.

The latch mechanism second portion 17 comprises a wedge or tetrahedral-shaped projection 40 extending outwardly from the closure member 4. The projection 40 has an aperture 41 extending from top to bottom therethrough (when in the closed position) and defining an opening for receiving the tongue 21. A bar 43 forms the radially outermost side of the aperture 41 and extends between opposite triangularly shaped sections 44 and 45 of the projection 40.

The aperture 41 is sufficiently wide to receive the distal end of the tongue 21. In particular, when the closure member 4 is closed, the cam surface 30 of the tongue 21 defining a tooth-like structure engages the lower side of the bar 43, thereby pushing the distal end of the tongue 21 inwardly and bending same backwards over the mating surface 27 until the recess 24 clears the bar 43. At this time, the distal end of the tongue 21 resiliently springs forward and the recess 24 snugly receives the bar 43 which is essentially shaped identical to the recess 24. The bar 43 thereafter interferingly restricts removal of the tongue 21 from the aperture 41 and, in particular, prevents the tongue distal end 29 from passing through the aperture 41 unless the tongue 21 is bent substantially rearward.

In the present embodiment, the bar 43 includes a radially outward projecting bead 47 which extends past the tongue 21 and recess 24 thereof. Also in the present embodiment, the bead 47 provides a fingerhold for a user to urge the closure member 4 upwardly when the opposite hand of the user is being utilized to push the upper end of the tongue 21 backwardly so that the bar 43 is free to clear the recess 24. In this manner, the closure member 4 can be opened.

The bar 43 also has a centrally located and upwardly projecting hemisphere or bump 49 thereon which is positioned so as to interferingly mate with the channel 28 of the tongue 21 when the tongue 21 is in the hard to close configuration thereof and when the closure member 4 is in the closed position thereof, such as is shown in FIG. 7 so as to further interfere with opening of the latch mechanism 6 when in the hard to open configuration thereof. Consequently, the degree of difficulty in opening the latch mechanism 6 depends on many features including the placement of the edge 32, the radius at the top of the surface 27, the flexibility of the tongue 21, the size and placement of the bar-like structure 31 and the interference between the channel 28 and bump 49.

It is noted that, although the hinge mechanism first and second portions 16 and 18 and the latch mechanism first and second portions 15 and 17 are shown on the container body 3 and closure member 4 respectively, it is foreseen that their positions could be reversed.

The hinge mechanism first portion 16 includes a pair of triangularly shaped and outwardly projecting stubs 51 and 52 joined by a bar 53. In the present embodiment, the bar 53 has a circular cross-section and is continuous between the stubs 51 and 52. However, it is foreseen that the bar could have other cross-sections including bumps, slots or the like or that the bar could be formed by discontinuous and spaced sections such as nipples extending outwardly from the stubs 51 and 52. The bar 53 is positioned close to the top of the container body 3 and is spaced from the container side wall 10 and aligned such that, if the bar 53 were next to the container side wall 10 that same would be tangential thereto. A stub wall 55 projects outwardly from the side wall 10 toward the bar 53 and in conjunction with the bar 53 and facing sides of the stubs 51 and 52 define an aperture 56 therebetween. The aperture 56 is sized so as to relatively snugly receive a mating portion of the hinge mechanism 6 as will be discussed below.

The hinge member second portion 18 can best be seen in FIGS. 11 and 13. The hinge member second portion 18 comprises a semi-circular sleeve 58 sized and shaped to be received on and rotate about the bar 53. The sleeve 58 is preferably resilient and has an inner diameter slightly smaller than that of the bar 53 such that the sleeve 58 tightly grips the bar 53.

The sleeve 58 is supported by a depending wall 59 extending outwardly and downwardly from the rear of the closure member 4. Extending outwardly from the closure member 4 on either side of the depending wall 59 are also a pair of struts 60 and 61 from which also depend a pair of ears 62 and 63 on the inner sides thereof. Between the depending wall 59, the semi-circular sleeve 58 and the ears 63 is defined a centrally located and circular channel 64 sized to be received about the bar 53. A pair of apertures 65 on either side of the sleeve 58 are positioned so as to allow the sleeve 58 to be positioned over the bar 53.

In particular, the sleeve 58 is somewhat resilient and the apertures 65 are readily biased to a more open position during assembly of this structure such that the bar 53 is forced between the apertures 65 and into the channel 64. It is noted that the configuration and geometry of the structure is such that the bar 53 may be placed in or taken from the channel 64 only when the closure member 4 is in an open configuration thereof. When the closure member 4 is in the closed configuration thereof, the stub wall 55 prevents the sleeve 58 moving in such a manner as to allow the bar 53 from becoming unengaged from the channel 64, thus effectively preventing any disassembly of the container 1 by manipulation of the hinge mechanism 5 when the closure member 4 is in a closed configuration thereof.

Figure 19:
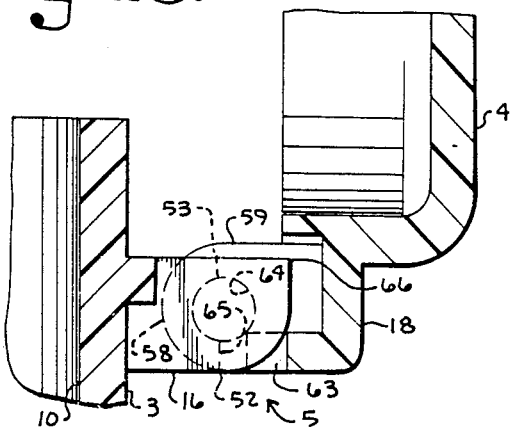
FIG. 19 is a fragmentary and enlarged cross-sectional view of the container, showing the closure member in a first open configuration thereof.
Figure 20:
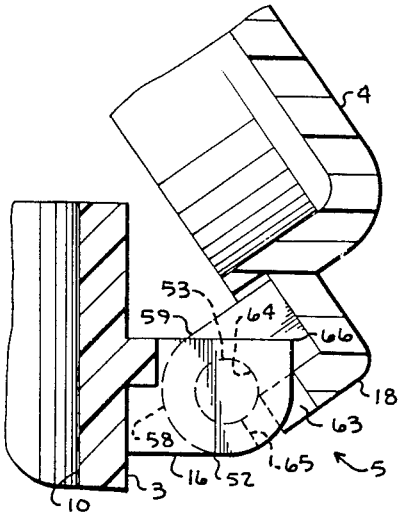
FIG. 20 is a fragmentary and enlarged cross-sectional view of the container, showing the closure member in a second open configuration thereof.
Figure 21:
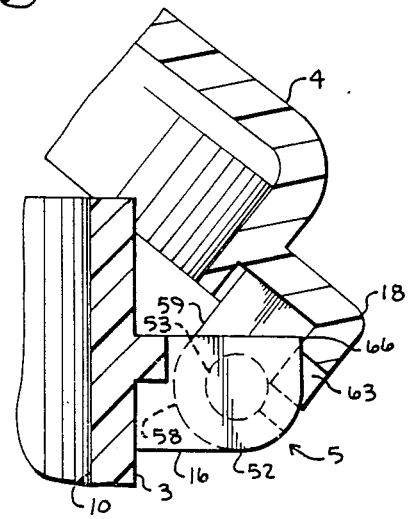
FIG. 21 is a fragmentary and enlarged cross-sectional view of the container, showing the closure member in a third open configuration thereof.

Shown in FIGS. 19 through 21 are various views of the closure member 4 in different states of opening. It is noted that the position of the stubs 51 and 52 is such that the outer and upper edges 66 thereof are positioned so as to selectively engage the struts 60 and 61 respectively of the hinge mechanism second portion 18, as can be seen in FIG. 21 (when the closure member 4 is in an open configuration thereof and at a preselected angle relative to the container body 3).

In particular, the edges 66 engage the struts 60 and 61 in such a manner that it requires exertion of a small degree of force on the top of the closure member 4 in order to close the closure member 4 past the position shown in FIG. 21. In this manner, the closure member 4 is held open until the user desires to close it at which time the user, while holding the container 1 in one hand, may use a finger of that hand to push downwardly on the closure member 4 thus pushing the edge 66 past the struts 60 and 61 for a "snap-like" closure. It is noted that this operation requires only the use of a single hand, yet the closure member 4 has at least one stable open position, as is seen in FIG. 21, wherein the closure member 4 will retain such position until urged therefrom by a user.

Figure 22:
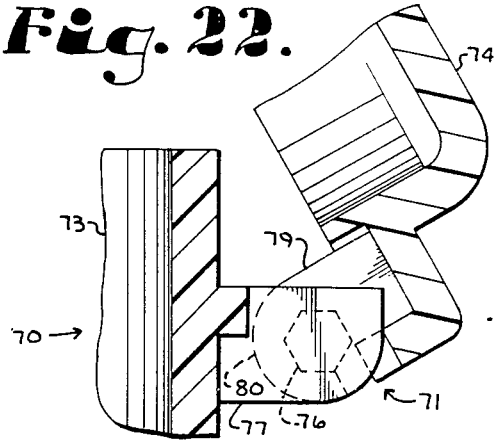
FIG. 22 is a fragmentary cross-sectional view of a first modified container showing a closure in a first open configuration thereof.
Figure 23:
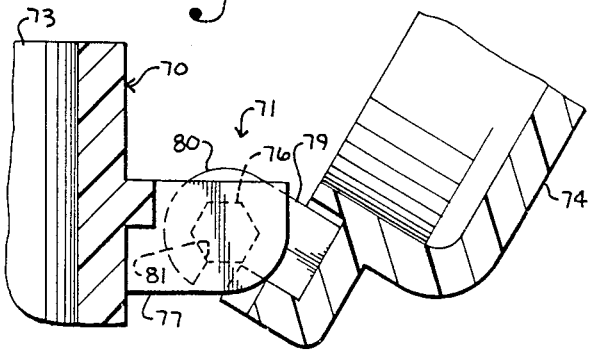
FIG. 23 is a fragmentary cross-sectional view of the first modified container, showing the closure in a second open configuration thereof.
Figure 24:
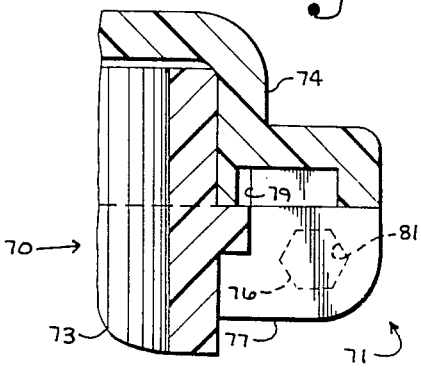
FIG. 24 is a fragmentary cross-sectional view of the first modified container, showing the closure in a third open configuration thereof.

Shown in FIGS. 22 through 24 is a first modified container 70 that is quite similar to the previous embodiment except in the design of the hinge mechanism 71 thereof. In particular, the modified container 70 includes a container body 73 and a closure member 74 connected by the hinge mechanism 71. The hinge mechanism 71 is in some ways similar to the hinge mechanism 5 of the previous embodiment except that a hexagonal shaped bar 76 extends between supporting struts 77 that extend from the container body 73. Likewise, the closure member 74 includes a depending wall 79 with a semi-circular sleeve 80. The interior surface 81 of the sleeve 80 is also hexagonal in shape and similar in size and configuration to the bar 76 so as to be snugly received thereabout. The sleeve 80 is sufficiently resilient so as to be rotatable about the bar 76 when pressure is applied to the closure member 74, but when the projections of the bar 76 align with the valleys of the sleeve 80, the sleeve 80 tends to hold that position and, therefore, keep the closure member 74 in such a fixed position until such time as pressure is applied again to the closure member 74 by a user to overcome the resistace to turning thereby provided.

Figure 25:
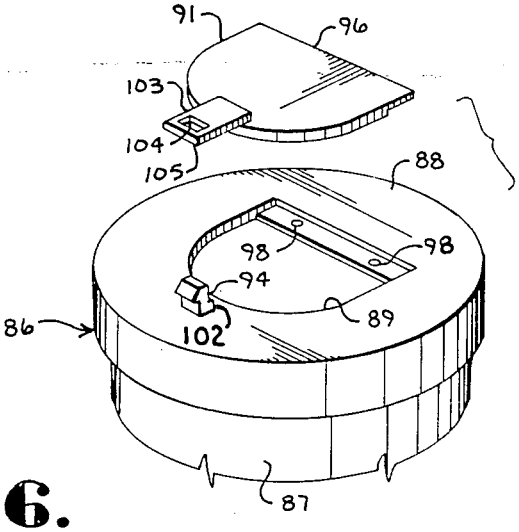
FIG. 25 is a fragmentary and exploded view of a second modified container in accordance with the present invention showing a container body, a closure member that is hingably connected to the body and a latch member.
Figure 26:
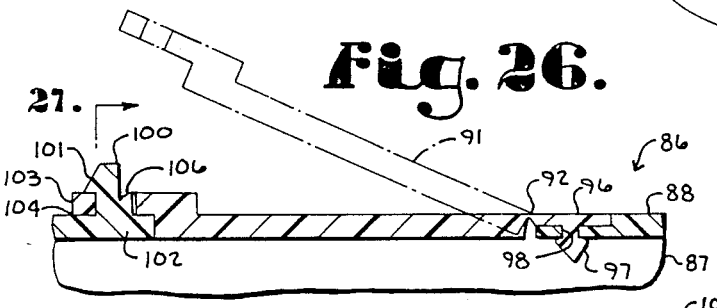
FIG. 26 is an enlarged and fragmentary cross-sectional view of the second modified container showing the closure member in a closed orientation thereof and showing the closure member in an open orientation thereof in phantom lines.
Figure 27:
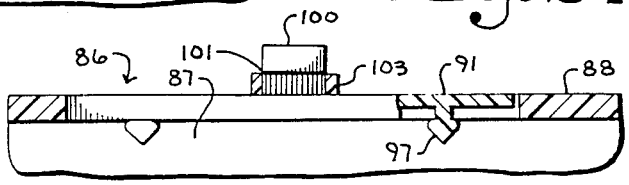
FIG. 27 is an enlarged and fragmentary cross-sectional view of the second modified container, taken along line 27—27 of FIG. 20.

Illustrated in FIGS. 25, 26 and 27 is a second modified embodiment of the present invention comprising a container generally designated by the reference numeral 86. The container 86 includes a container body 87 having an upper wall 88 with an aperture 89 therethrough. A closure member 91 is interconnected to the upper wall 88 by a hinge 92. A latch mechanism 94 is utilized to secure the closure member 91 in a closed configuration.

The hinge 92 of the container 86 comprises a flexible strip 96 attached to the closure member 91 and having a pair of large headed struts 97 extending therefrom. The struts 97 are positioned so as to fit into mating apertures 98 along the upper wall 88 and to lock therein.

The latch mechanism 94 includes a resilient member 100 mounted on the upper surface of the upper wall 88 and extending outwardly therefrom. The resilient member 100 includes a tooth 101 extending outwardly therefrom. Positioned behind the member 100 is a stub wall 102 with an upper outer radius forcing the member 100. The wall 102 is shaped and positioned such that the member 100 must be braced to bend back over the wall 102 in order for the tooth 101 to clear the front of a tab 103. In particular, the closure member 91 includes the rectangular tab 103 extending outwardly therefrom so as to be positioned over the resilient member 100 when the closure member 91 is in a closed position thereof. The tab 103 includes an aperture 104 defining a bar 105 at the outermost side thereof. When in the closed position of the closure member 91, the resilient member 100 is positioned so that the tooth 101 is positioned over the bar 105. In order to open the closure member 91, the resilient member 100 must be biased backward against an edge 106 of the wall 102 so that the tooth 101 clears the bar 105 while simultaneously pulling upward on the closure member 91.

Shown in FIGS. 28 through 30 is a third modified embodiment of a container according to the present invention and generally designated by the reference numeral 112. The container 112 includes a container body 113 and a lid or closure member 114. The container 112 is similar in many respects to the container 1 of a previously described embodiment. Therefore, the major differences between the embodiments will be described in detail rather than repeating many of the common details therebetween.

In particular, the container 112 includes a latch mechanism 116 and a hinge mechanism 117. The latch mechanism 116 includes a rotatable tongue or latch member 118 having an easy open position as shown in FIG. 27 and a hard to open position as shown in FIG. 29. The latch member 118, when in the hard to open position thereof, has a recess 119 which engages a bar 120 mounted upon the closure member 114, as described in the previously described embodiment.

Of significant difference between this embodiment and the first embodiment is that the closure member includes a shield 122 extending radially outward from near a top thereof so as to be spaced from but cover the bar 120 and the latch member 118 when the latch member 118 is in the hard to open position thereof. The shield 122 functions to prevent children from using their teeth to bite off the top of the latch member 118 and thereby adds an extra degree of child resistance to the container 112. The latch mechanism 116 of the present embodiment also differs from the previous embodiment in that the bar 120 is effectively flush with the most radially exterior surface of the latch member 118 when the latch member 118 is in the hard to open position thereof. Effectively, this means that the bar 120 is not accessible to a user to pry the closure member 114 upwardly when the latch member 118 is pushed back sufficiently far for the recess 119 to clear the bar 120. Consequently, shoulders or ears 124 and 125 are provided on the closure member 114 that allow gripping by the user for prying the closure member 114 upwardly when the latch member 118 is released from the bar 120.

A further modification of the present embodiment over the first embodiment is in the hinge mechanism 117. The hinge mechanism 117 of the present embodiment is otherwise similar to the hinge mechanism of the first embodiment except that a shield 127 is provided to extend over the rearward portion of the hinge mechanism 117. The shield 127 provides a smooth exterior surface to a child trying to use their teeth to damage the hinge mechanism 117 and thereby open the container 112. This provides a further degree of child resistance to the container 112.

FIGS. 31 and 32 illustrate a fourth modified container of the present invention generally designated by the reference numeral 130. The container 130 includes a body 131 and a closure member 132 which are connected together by latch mechanism 133. The container 130 is quite similar to the container 1 of the first embodiment described except that tamper indicating means such as tamper guard 134 is provided.

In particular, the latch mechanism includes a resilient member 135 having an upper tooth 136 which is swingable between easy open and easy to close positions once the container 130 is initially open. The closure member 132 has an outwardly extending bar 137 which is manually received by a recess 138 of the resilient member 135. The tamper guard 134 is an enclosure which is shaped to fit about the distal portion of the resilient member 135 and, in particular, the tooth 136. The tamper guard 134 is frangibly connected to the closure member 132 such that it may be removed by a user prior to use of the container 130. Prior to removal of the tamper guard 134, the container 130 cannot be opened as the tamper guard 134 interferes with the user's ability to push the tooth 136 backwardly so as to clear the bar 137. Once the tamper guard 134 is broken away, the tooth 136 can be pushed by a user so as to clear the bar 137 at which time the closure member 132 can be raised. It is noted that the operation of pushing the resilient member 135 and raising the closure member 132 must be accomplished simultaneously and normally requires the use of both hands.

It is to be understood that while certain forms of the present invention have been illustrated and described herein, it is not to be limited to the specific forms or arrangement of parts described and shown.

What is claimed and desired to be secured by Letters Patent is as follows:

1. A latch mechanism for securing a closure member to a container body including:

(a) a latch adapted to be connected to a first of the closure member or the container body and having a closed position and an open position relative to the closure member;

(b) said latch comprises an elongate tongue connected near one end thereof to the first of the closure member or the container body and having a rear surface and further having a tooth extending outwardly opposite said rear surface from near a distal end thereof;

(c) a bar adapted to be attached to the second of the closure member or the container body and being positioned such that, when said latch is in the closed configuration thereof, said bar generally encircles said tongue in conjunction with the second of the closure member or container body and said tooth holds said bar and is adapted to prevent the closure member from being opened relative to the container body until said tooth is biased rearwardly relative to said bar and said tongue is axially moved, generally perpendicularly with respect to said bar so that the closure member is simultaneously biased to an open position relative to the container body to urge said bar past said tooth such that said tooth must be biased rearwardly and the closure member simultaneously biased open relative to the container body in order to move from said latch closed position to said latch open position;

(d) and further wherein said latch includes means thereon and said bar is configured relative to said latch such that said tooth cannot be depressed rearward and said bar moved from the closed position to the open position simultaneously by use of a single finger; and (e) a projection adapted to extend outwardly from the second of the closure member or the container body in substantial circumferentially spaced relationship to said bar; said projection extending sufficiently outward to allow a user to grasp thereunder with a finger, so as to open the closure member relative to said container body when a different finger is depressing said latch tooth rearwardly whereby at least two fingers are required to be simultaneously used with some dexterity in order to open said latch mechanism.

2. A latch mechanism for securing a closure member to a container body including:

(a) a latch adapted to be connected to a first of the closure member or the container body and having a closed position and an open position relative to the closure member;

(b) said latch comprises an elongate tongue connected near one end thereof to the first of the closure member or the container body and having a rear surface and further having a tooth extending outwardly opposite said rear surface from near a distal end thereof;

(c) a bar adapted to be attached to the second of the closure member or the container body and being positioned such that, when said latch is in the closed configuration thereof, said tooth holds said bar and is adapted to prevent the closure member from being opened relative to the container body until said tooth is biased rearwardly relative to said bar and the closure member is simultaneously biased to an open position relative to the container body to urge said bar past said tooth such that said tooth must be biased rearwardly and the closure member simultaneously biased open relative to the container body in order to move from said latch closed position to said latch open position;

(d) said latch also includes means thereon and said bar is configured relative to said latch such that said tooth cannot be depressed rearward and said bar moved from the closed position to the open position simultaneously by use of a single finger;

(e) said latch further includes structure means spaced from said tooth and projecting in the same direction as said tooth; said structure means and said tooth relatively snugly receiving said bar therebetween when said latch is in said closed position thereof; said structure means being generally flush with a front of said bar when said latch is in the closed position thereof so as to provide a user no place to grasp said bar opposite said tooth and thereby inhibit a user from using said bar to open the closure member relative to said container body; and (f) a projection adapted to extend outwardly from the second of the closure member or the container body in substantial circumferentially spaced relationship to said bar; said projection extending sufficiently outward to allow a user to grasp thereunder with a finger, so as to open the closure member relative to said container body when a different finger is depressing said latch tooth rearwardly, whereby at least two fingers are required to be simultaneously used with some dexterity in order to open said latch mechanism.

3. In a latch mechanism for securing a closure member to a container body including a multipositional latch hinged to a first of the closure member or the container body and allowing a user to select between a hard to open configuration and an easy to open configuration, the improvement comprising wherein:

(a) said latch is an elongate tongue hinged at one end thereof to the first of the closure member or the container body and having a rear surface and further having a tooth extending outwardly opposite said rear surface from near a distal end thereof;

(b) the first of the closure member or the container body also having positioned thereon a mating surface that abuts against said rear surface when said latch is in the hard to open configuration thereof; said mating surface having an upper edge whereabout said tongue is bent during opening of said latch mechanism; and said upper edge having a curved surface extending inwardly wherein a degree of curvature of said curved surface is directly proportioned to a degree said tongue must be bent during opening of said latch mechanism thereby regulating the difficulty of opening said latch mechanism when said latch is in the hard to open position;

(c) the second of the closure member or the container body having extending therefrom a bar; said bar being positioned such that, when said latch is in the hard to open configuration thereof, said tooth is resiliently biased over said bar and said mating surface is aligned to abut against said back surface in close proximity to said bar, such that a user, to open the latch mechanism, must manually bias the distal end of said latch to bend the latch at the upper edge of the mating surface such that said tooth clears said bar while simultaneously lifting said closure member.

4. In a latch mechanism for securing a closure member to a container body including a latch secured at one end thereof to a first of the closure member or the container body; said closure member and said container body being movable relative to each other between an open and a closed configuration, the improvement comprising wherein:

(a) said latch comprises an elongate tongue having a rear surface and having a tooth extending outwardly opposite said rear surface from near a distal end thereof and further having a ridge extending outwardly opposite said rear surface across said tongue generally parallel to and in a spaced relation to said tooth; and (b) the second of the closure member or the container body having extending therefrom a bar; said bar being positioned such that, when said latch is in the closed configuration thereof, said bar is positioned between said tooth and said ridge such that a user, to open said latch mechanism, must manually bias the distal end of said latch to bend the latch rearwardly relative to said bar such that said tooth clears said bar while simultaneously lifting said closure member relative to said container body; said ridge inhibiting a user from opening the latch mechanism by simultaneously pushing inward on said tongue and upward on said latch mechanism such that the user must push on said tongue near said tooth while simultaneously lifting said closure member at a spaced location from said tooth requiring substantial manual dexterity.

5. In a latch mechanism for securing a closure member to a container body including a multipositional latch hinged to a first of the closure member or the container body and allowing a user to select between a hard to open configuration and an easy to open configuration, the improvement comprising wherein:

(a) said latch is an elongate tongue hinged at one end thereof to the first of the closure member or the container body and having a rear surface and having a tooth extending outwardly opposite said rear surface from near a distal end thereof and further having an elongate channel extending from said rear surface to near an innermost edge of said tooth;

(b) the first of the closure member or the container body also having positioned thereon a mating surface that abuts against said rear surface when said latch is in the hard to open configuration thereof; said mating surface having an upper edge whereabout said tongue is bent during opening of said latch mechanism; and (c) the second of the closure member or the container body having extending therefrom a bar; said bar having a bead projecting therefrom; said bar being positioned such that, when said closure member is closed relative to said container body and said latch is in the hard to open configuration thereof, said tooth is resiliently biased over said bar and said elongate channel interferingly mates with said projecting bead and said mating surface is aligned to abut against said back surface in close proximity to said bar, such that a user, to open said latch mechanism must manually bias the distal end of said latch to bend the latch at the upper edge of the mating surface such that said bead disengages from said channel and said tooth clears said bar while simultaneously lifting said closure member.

6. In a latch mechanism for securing a closure member to a container body including a multipositional latch hinged to a first of the closure member or the container body and allowing a user to select between a hard to open configuration and an easy to open configuration, the improvement comprising wherein:

(a) said latch is an elongate tongue hinged at one end thereof to the first of the closure member or the container body and having a rear surface and further having a tooth extending outwardly opposite said rear surface from near a distal end thereof;

(b) the first of the closure member or the container body also having positioned thereon a mating surface that abuts against said backing surface when said latch is in the hard to open configuration thereof; said mating surface having an upper edge whereabout said tongue is bent during opening of said latch mechanism;

(c) the second of the closure member or the container body having extending therefrom a bar; said bar being positioned such that, when said latch is in the hard to open configuration thereof, said tooth is resiliently biased over said bar and said mating surface is aligned to abut against said back surface in close proximity to said bar, such that a user, to open the latch, must manually bias the distal end of said latch to bend the latch at the upper edge of the mating surface such that said tooth clears said bar while simultaneously lifting said closure member; and (d) first and second walls extending generally radially outward from the first of said closure member or container body; said first and second walls being positioned on either side of said tongue and in close proximity thereto when the closure member is in a closed position thereof and extending sufficiently outward so that the teeth of a child cannot readily be positioned between said first and second walls to effectively engage said tongue to enable the teeth to pry under said tongue and thereby force said latch mechanism open.

7. A latch mechanism according to claim 6 including the container body and the closure member and wherein said container body includes:

(a) a circumferential ridge extending about a mouth thereof; said ridge being positioned so as to extend over a bottom surface of said closure member when said closure member is in a closed position so as to inhibit a child from grasping said bottom surface to pry said closure member to an open position.

8. A latch mechanism for securing a closure member to a container body including:

(a) a latch integrally connected to a first of the closure member or the container body;

(b) said latch is an elongate tongue attached at one end thereof to the first of the closure member or the container body and having a rear surface and further having a tooth extending outwardly opposite said rear surface from near a distal end thereof;

(c) the first of the closure member or the container body also having positioned thereon a mating surface that abuts against said rear surface during opening of said latch mechanism; said mating surface having an edge whereabout said tongue is bent during opening of said latch mechanism; and (d) the second of the closure member or the container body having extending therefrom a bar; said bar being positioned so that, when said latch mechanism is moved to a closed configuration thereof, said tooth is resiliently biased over said bar and said mating surface is aligned to abut against said back surface in close proximity to said bar, such that a user, to open said latch mechanism, must manually bias the distal end of said latch to bend the latch at the edge of the mating surface such that said tooth clears said bar while simultaneously lifting said closure member.

* * * * *